United States Patent [19]

Allred

[11] 3,960,702

[45] June 1, 1976

[54] VAPOR PHASE WATER PROCESS FOR RETORTING OIL SHALE

[75] Inventor: Victor D. Allred, Littleton, Colo.

[73] Assignee: Marathon Oil Company, Findlay, Ohio

[22] Filed: Aug. 8, 1974

[21] Appl. No.: 495,483

[52] U.S. Cl. ..... 208/11 R

[51] Int. Cl.[2] ..... C10G 1/02

[58] Field of Search ..... 208/11

[56] References Cited

UNITED STATES PATENTS

| | | | |
|---|---|---|---|
| 2,665,238 | 1/1954 | Truitt et al. | 208/11 |
| 2,911,349 | 11/1959 | Coulson | 208/11 |
| 3,051,644 | 8/1962 | Friedman et al. | 208/11 |
| 3,520,795 | 7/1970 | Schulman et al. | 208/11 |
| 3,565,784 | 2/1971 | Schlinger et al. | 208/11 |
| 3,577,338 | 5/1971 | Gifford | 208/11 |
| 3,617,471 | 11/1971 | Schlinger et al. | 208/11 |

*Primary Examiner*—Delbert E. Gantz
*Assistant Examiner*—James W. Hellwege
*Attorney, Agent, or Firm*—Joseph C. Herring; Jack L. Hummel

[57] ABSTRACT

Oil shale is retorted using vapor phase water at about 850°–950°F, at a superficial gas velocity of about 20 feet per minute and at a pressure in the range of from about 1 to about 150 p.s.i.a.

6 Claims, 8 Drawing Figures

VAPOR PHASE WATER PROCESS FOR RETORTING OIL SHALE

BACKGROUND OF THE INVENTION

1. Field of the Invention

The present invention relates to the field of retorting of oil shale, particularly by treatment with superheated water vapor.

2. Description of the Prior Art

Technology for producing oily matter from kerogenous shales is very old, and for over 100 years, methods of retorting have been widely investigated. The use of superheated steam or vapor phase water (VPW) as a retorting agent has also been widely advocated, for example: Wells, W. E., and Ruark, J. R., *Pilot Plant Batch Retorting of Colorado Oil Shale*, pp 9–11, RI 4874, USBM, May 1952, showed the the use of steam in the Royster retort increased the shale off-gas volume by a factor of 2, and also markedly increased the hydrogen content of the off-gas; *Synthetic Liquid Fuels*, Part II, *Oil from Oil Shale*, pp 45–49, RI 4943, USBM, January 1953, and pp 35–39, RI 5044, USBM, April 1954, using an entrained solids retort, reported data on the use of high-temperature steam (1000–1500°F.) as the entraining agent; Gavin, M. J., and Desmond, J. S., *Construction and Operation of the USBM Experimental Oil-Shale Plant* 1925–1927, USBM Bulletin No. 315, reported on the U.S. Bureau of Mines Experimental oil shale plant at De Beque, Colo., mentioning the use of steam injection in the operation of the 'Pumpherston retort' during its operation in 1925 through 1927; Peck discusses the distillation of oil shale under fluidizing conditions using steam in U.S. Pat. No. 2,449,615; Belser disclosed the use of steam as a means of in situ recovery in U.S. Pat. No. 2,725,939; Schulman, in U.S. Pat. No. 3,520,795, outlines the use of steam in a shaft kiln as a means of retorting oil shale. In this patent, he is restricted to the temperature range, 950° to 1050°F.; Beard claims a method of in situ recovery of oil shale using steam in the temperature range, 550° to 850°F., in U.S. Pat. No. 3,739,851; Papadopoulos and Ueber in U.S. Pat. No. 3,741,306 claim an in situ method of converting kerogen to shale oil using steam injection at 650°F.; and Gifford in U.S. Pat. No. 3,577,338 claims a method for retorting using steam and oxygen. British patent specification No. 1,326,455 contacts oil shale at a temperature in the range of 750°–1500°F. and a pressure in the range of 300–1000 p.s.i.g. with from 0.01 to 0.6 tons of $H_2O$ per ton of oil shale and with a hydrogen-rich gas.

The investigations detailed in this patent application have led to the discovery that the pressure range under which treatment of oil shale with superheated water vapor occurs is surprisingly critical and that, furthermore, there is a critical interrelationship between the pressure at which said contact occurs and the superficial gas velocity required for maximum recovery of organic values from the oil shale. None of the above references teaches the importance of these factors or of the interrelationship between them. The interrelationship is particularly surprising inasmuch as, under certain conditions, increasing pressure actually deters the production of maximum organic values with other variables remaining the same.

SUMMARY OF THE INVENTION

The present invention employs vapor phase water as a dual heat transfer agent/chemical reactant in the pyrolysis of oil shale to produce hydrocarbons. Pressure, temperature and superficial gas velocity are maintained within the ranges specified below in order to achieve maximum efficiency in the recovery of hydrocarbons.

DESCRIPTION OF THE DRAWINGS

FIG. 3 is similar to FIG. 2 except that the contact is accomplished at approximately 47 p.s.i.a.

FIG. 4 is similar to FIG. 2 except that the contact is accomplished at approximately 82 p.s.i.a.

Figure 2:
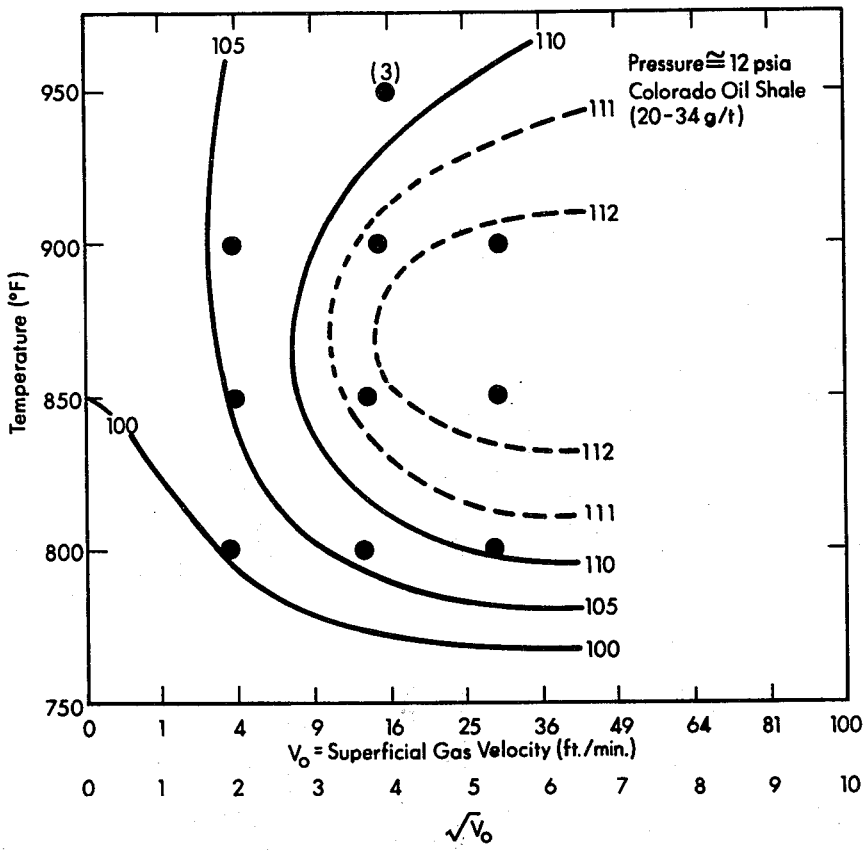
FIG. 2 is a plot of temperature and degrees Fahrenheit vs. superficial gas velocity with contour lines of equal oil recovery plotted onto the grid, all relating to contacting Colorado oil shales containing 20 to 34 gallons per ton with superheated vapor at a pressure of approximately 12 pounds per square inch absolute (p.s.i.a.).
Figure 3:
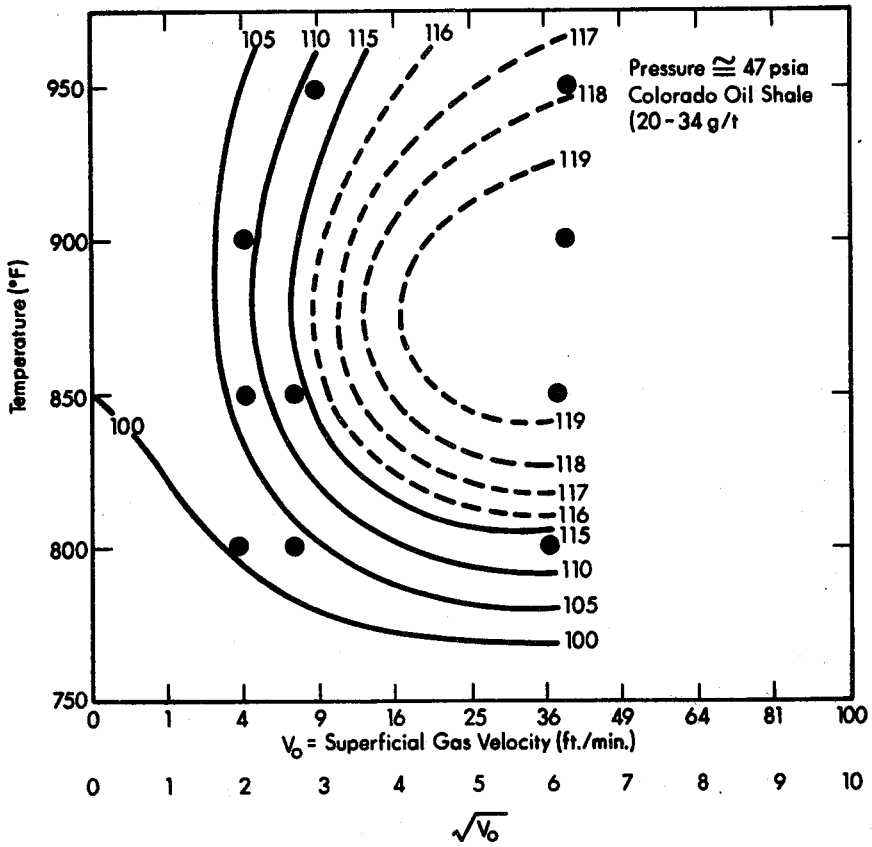
Figure 4:
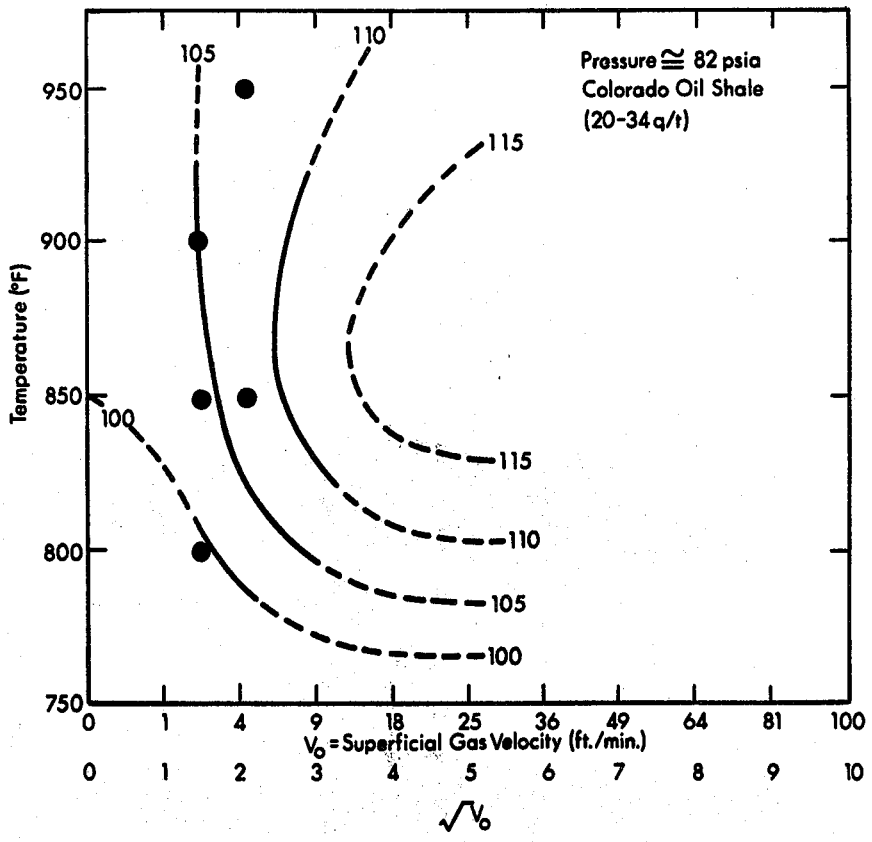

Experimental points are represented by black dots on each of FIGS. 2–4.

Figure 1:
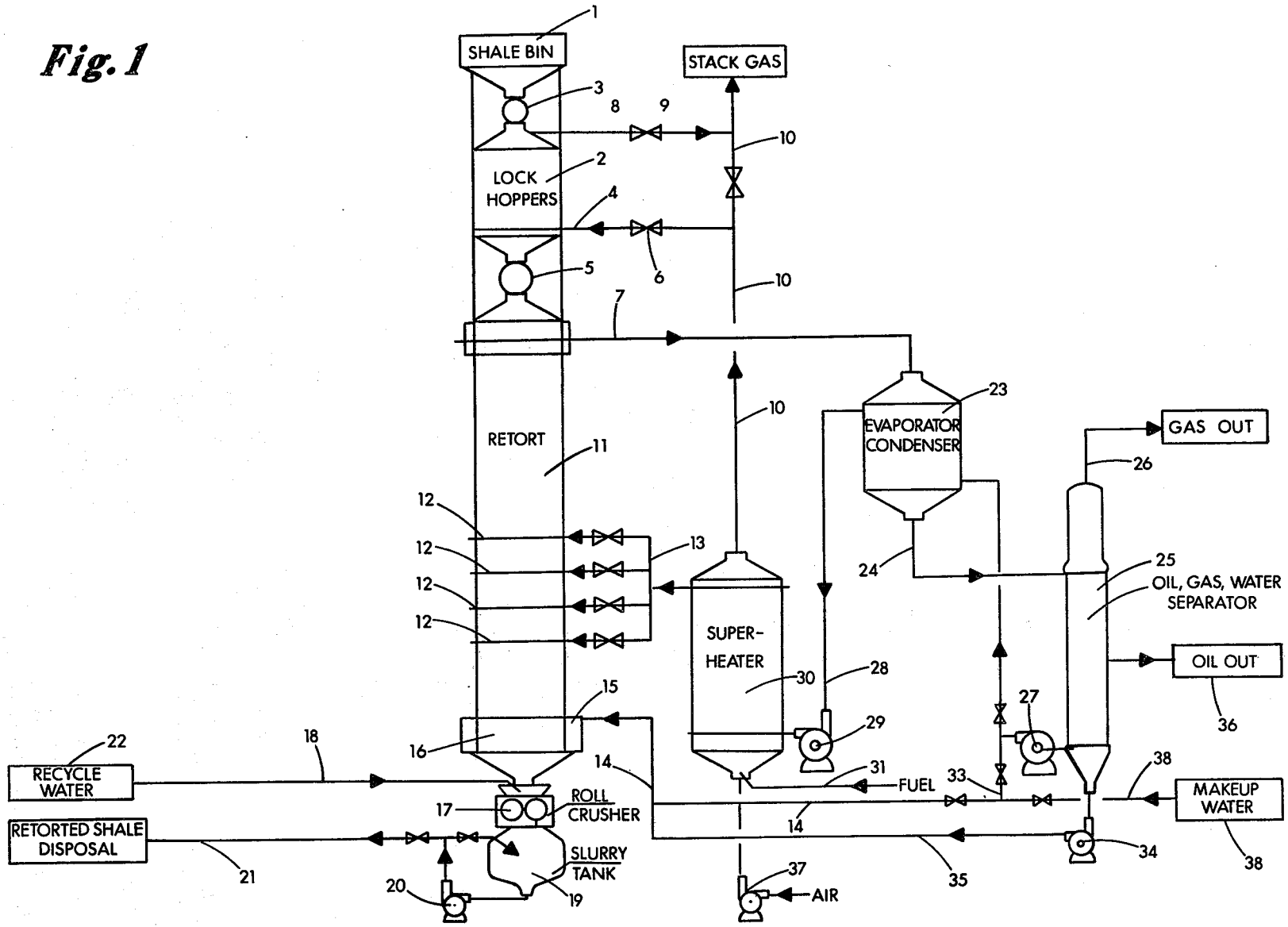
FIG. 1 is a schematic diagram of the process steps utilized in the preferred embodiments of the present invention.
Figure 5:
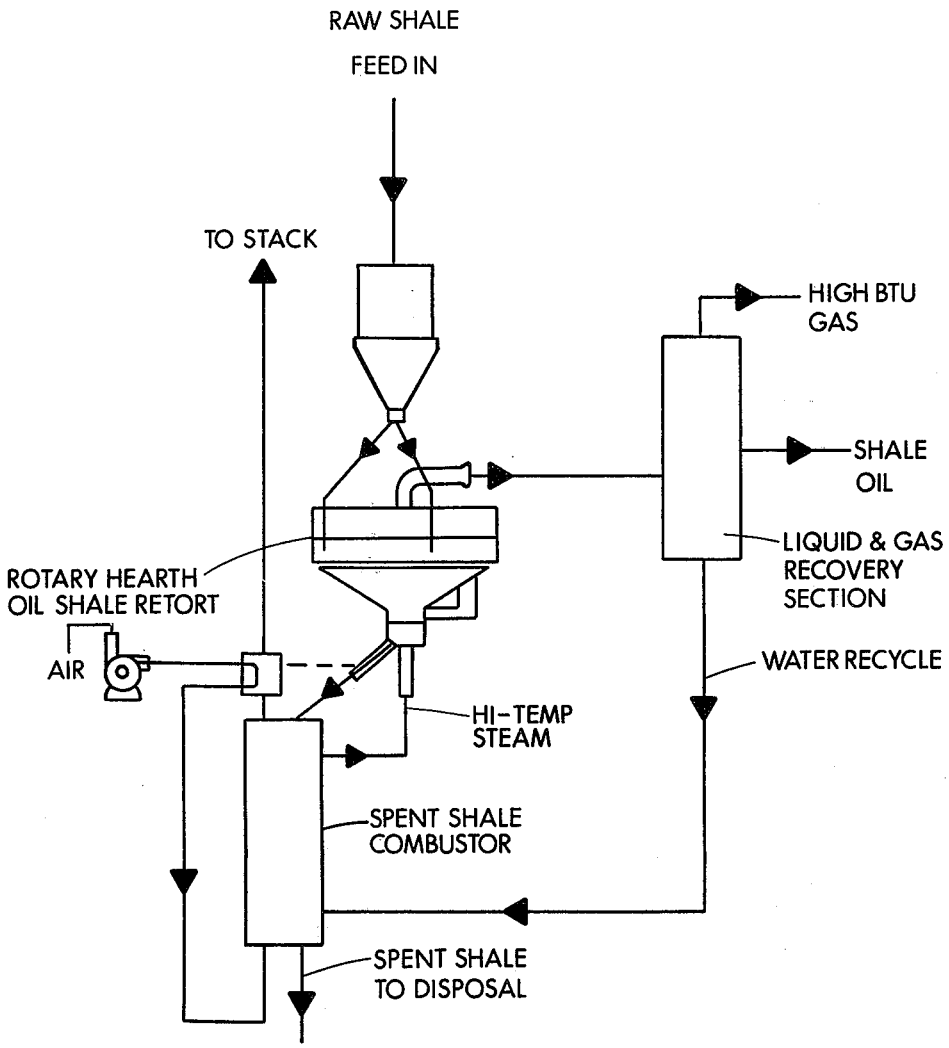

FIG. 5 is a schematic diagram of another embodiment of the invention in which a rotary hearth is substituted for the vertical retort utilized in FIG. 1.

Figure 6:
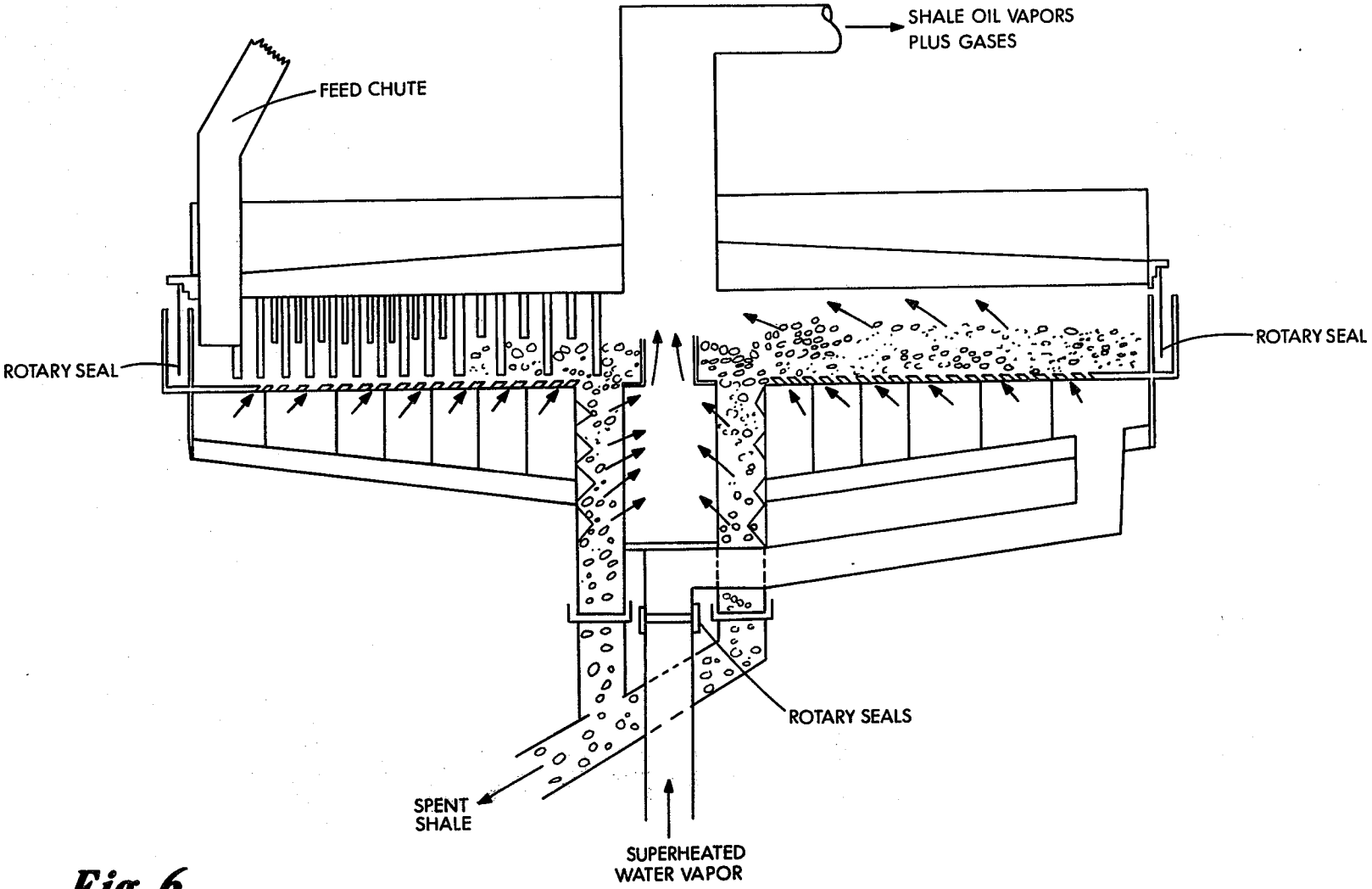

FIG. 6 shows a cross section of the rotary hearth furnace employed with the present invention, to show additional detail.

Figure 7:
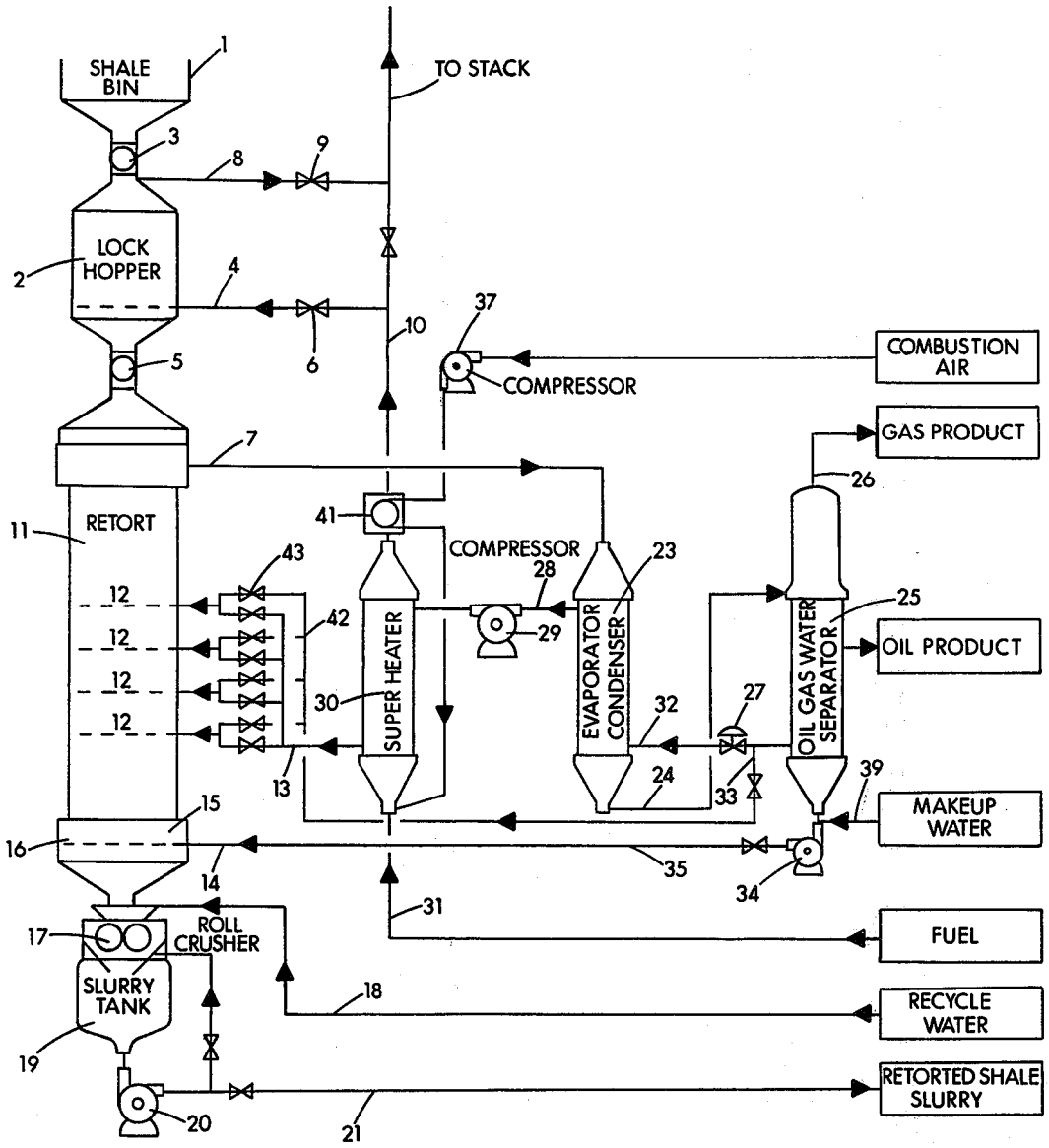
Figure 8:
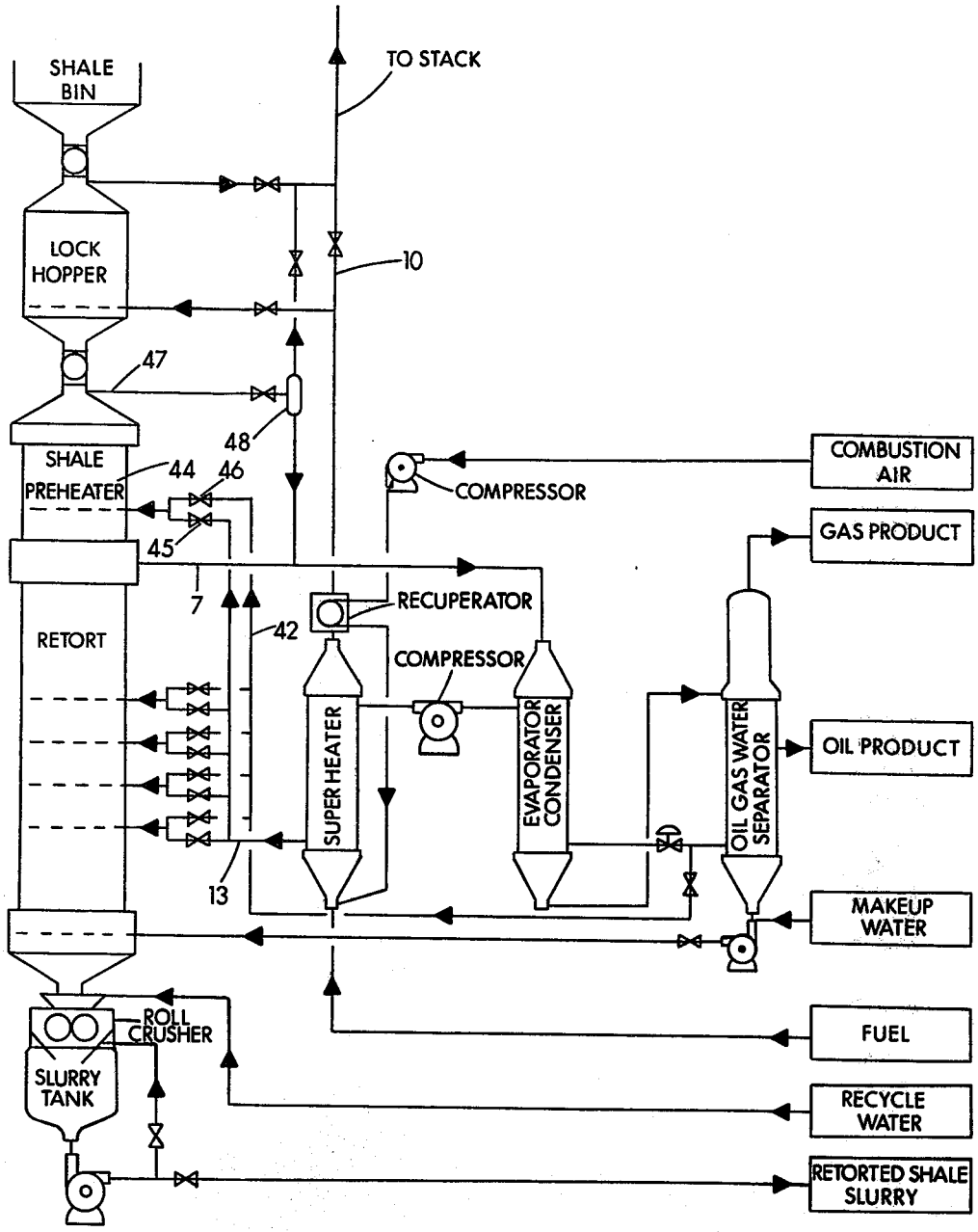

FIGS. 7 and 8 are schematic diagrams of other embodiments described in Examples II and III, respectively.

DESCRIPTION OF THE PREFERRED EMBODIMENTS

Starting Materials: Superheated water vapor: Although not absolutely necessary the superheated water vapor is preferably prepared from boiler feed quality water, during operation, preferably water which has been recycled after condensing out of the effluent product stream is acceptable. Alternatively, the heated water vapor may be dry steam from geothermal sources obtained by drilling a well to such sources as may be located in the area of the oil shale deposits and admitting the superheated steam from such geothermal source into contact with the oil shale either in retort or, preferably, in situ.

Oil Shale: The oil shale utilized can be any of the naturally occurring kerogen-containing deposits including e.g., Colorado oil shale, Chattanooga oil shale, Brazilian oil shale, Scottish oil shale, Scandanavian oil shale, Estonian oil shale, Manchurian oil shale, Australian oil shale, etc. The process is particularly preferred for use with those oil shales such as Colorado oil shale which contain large amounts of alkaline carbonate minerals, that is, minerals which contain calcium and magnesium usually in the form of carbonates. Such metal carbonates decompose relatively at a very slow rate at temperatures below 1000°F. The present process, by operating at temperatures which minimize the decomposition of said such metal carbonates, minimizes the percentage of metal oxides contained in the effluent ash from the retorting process. By minimizing the percentage of metal oxides, the high alkilinity which has characterized the solid effluents from many of the oil shale retorting processes is controlled and the effluent solid retorted shale provides a substrate capable of sustaining vegetation. That is, the solid effluents from the present process are almost neutral in pH and provide a much more environmentally adaptable material for disposal in that they break down readily into silt which makes an acceptable soil and readily lends itself to revegatation. As illustrated by the substantial controversy over the possible adverse environmental effects of oil shale retorting waste disposal lands, this feature is a particularly important advantage of the present invention.

The oil shale will preferably be crushed or otherwise comminuted to a particle size in the range of from about an average particle diameter of from about 0.1 to about 2 inches.

Temperature: As explained above, the temperature will preferably be in the range of from about 800° to 950°, more preferably from about 850° to about 900°, and most preferably from about 850° to about 880°F. This range of temperature is especially important in conserving thermodynamic values, in maximizing recovery of organic values, and in providing a solid waste which is capable of revegatation, as discussed above.

Pressure: As discussed above, the pressure for use with the present invention during contact between the superheated water vapor and the oil shale will probably be in the range of from about 1 to about 150 p.s.i.a., more preferably from about 2 to about 100 p.s.i.a., and most preferably from about 35 to about 75 p.s.i.a.

Superficial Gas Velocity: As mentioned above, the superficial gas velocity will preferably be in the range of from about 20 to about 1000 feet per minute, more preferably from about 20 to about 600, and most preferably from about 50 to about 400 feet per minute. As shown in FIGS. 2–4, the superficial gas velocity at maximum recovery of organic values (expressed in those figures as percent of Fischer assay), varies from about 112% at 12 p.s.i.a., 119% at 47 p.s.i.a. to about 115% at 82 p.s.i.a.

Time: While not narrowly critical, the time of contact between the oil shale and the superheated water vapor will preferably be in the range of from about 0.01 to about 90 minutes, more perferably from about 0.1 to about 60 minutes, and most preferably from about 15 to about 60 minutes. It should be understood that the optimum contact time will vary somewhat according to the particle size of the oil shale to be contacted with larger particle sizes requiring longer contact time to be thoroughly penetrated by heat and water vapor.

EXAMPLES

EXAMPLE I

Crushed and sized oil shale rock is stored in a surge bin 1 in sufficient quantity to fill a lock hopper 2. Shale enters the lock hopper 2 through a valve 3 and the hopper is pressurized to about 35–70 p.s.i.g. and the shale heated to about 300°F. in the lock hopper by hot stack gas which enters through line 4.

Lock hopper 2 is operated batchwise so there must be at least two for each retort. The shale enters the lock hopper with valves 5 and 6 closed so that the retort pressure is maintained constant and the retort product gas stream 7 does not leak into the stack offgas stream 8. As soon as the hopper 2 is charged with shale, valve 3 is closed and valve 6 is opened to pressurize it. Valve

9 is a back pressure regulator which allows the hot gases to pass through the bed and out to the stack gas breeching 10, once the lock hopper has reached the desired pressure.

As soon as the lock hopper is pressurized and the shale at the bottom has reached the desired temperature valve 5 can be opened and the shale allowed to pass through a distributor such as is described in U.S. Pat. No. 3,071,230 into the retort 11. Operation of the lock hoppers 2 is staggered so that shale is being continuously fed to the retort.

As an alternative, rotating star valve, a feed mechanism could be used, particularly at lower pressures, i.e., about 35 p.s.i.g., in which case only one lock hopper, now only a preheater would be used. In this case the rotating valve 3 provides a pressure seal as well as a positive feed mechanism.

The shale, after it enters the retorting zone, passes by gravity countercurrent to an upward moving gas stream comprised of superheated water vapor, vaporized shale oil, and gases containing carbon oxides, hydrogen, and light hydrocarbons.

As the upward moving gas stream contacts the shale it is cooled and the shale is heated. However, the gas stream will not be cooled to the condensation temperature of the water vapor since the shale has been preheated to above this temperature in the lock hopper.

Pyrolysis of the organic values in the shale to produce shale oil, gases, and carbon, occurs as the temperature is elevated (the most desirable temperature being about 850°F.). To achieve this temperature, superheated water vapor is injected into the retort 11 through the gas distributors 12 from the manifold 13.

After the retorted shale has passed through the pyrolysis zone it is desirable to cool it, prior to discharge, to near the condensation temperature of water. This is accomplished by injecting water from a line 14 through a distributor 15 onto the shale in the vicinity of the shale discharge grate, which grate is similar to that described in U.S. Pat. Nos. 3,027,147 and 3,704,011. As the water contacts the hot shale it is turned to steam and passes upward through the retort cooling the shale and being itself preheated to the pyrolysis zone temperature. In addition to cooling the retorted shale this water vapor also chemically reacts with the carbonaceous organic residue on the shale to produce carbon monoxide and hydrogen. The carbon monoxide further reacts with the organic residue to form carbon dioxide.

From the discharge mechanism 16 the retorted shale passes through a roll crusher 17 where it is crushed in the presence of recycled water from line 18 to a sufficiently small size to be readily pumped as a slurry to a disposal site (backfilling a mined out area or other environmentally suitable location). The slurry is prepared in tank 19 and agitation to keep it suspended is provided by the pump 20 which also provides the power to move the slurry to the disposal site through line 21. Water 22 is reclaimed from the disposal site and recycled back to crusher through line 18.

The advantage of using a slurry system for the retorted shale disposal is twofold. First, a lock hopper is not required on the discharge end of the retort to maintain pressure in the retort, and second, since low temperature retorted shale crushes very readily it can be easily and continuously be transported in fluid form over considerable distances as may be required for disposal.

The retort off-gas leaves the unit through line 7. The off-gas consists of water and shale oil vapors, light hydrocarbon gases, hydrogen, and carbon oxides. The shale oil vapors and water vapor are condensed in the tubes of heat exchanger 23 and pass with the non-condensible gases through line 24 to an oil, gas, and water separator 25. The non-condensed gases pass through line 25 to conventional gas scrubbing units where the carbon dioxide, hydrogen sulfide, and ammonia are removed. The resultant gas contains about 70% hydrogen mixed with about 30% light hydrocarbon gases. The hydrocarbon gases are predominately methane, but contain appreciable quantities of ethane, ethylene, propane, and propylene, as well as lighter hydrocarbons ($C_4$–$C_6$).

Water is drawn off at two points. The bulk is removed by pump 27 and passes through line 32 where it is returned to the shell side of the heat exchanger 23 at a pressure near or below atmospheric. The reduced boiling point of this water over the off-gas phase provides the driving force to evaporate the water, and thus recovers the latent heat of evaporation which is the principal heat burden of the process.

The water vapor from the heat exchanger 23 then passes through line 28 to compressor 29 where the pressure is increased to near that of the retort. It then passes through a superheater 30 where the temperature is raised to about 1000°F. prior to entering the retort through line 13. The superheater is fired either by process oil or gas 31 and is operated at a pressure slightly greater than the retort pressure.

Combustion air is supplied under pressure by a compressor 37. It is also desirable to preheat the combustion air by passing through a heat exhanger — either with the stack gas stream or the retort off-gas.

If desired, a portion of the water stream from pump 27 may be diverted to the retort through line 14 to quench the retorted shale.

The second point of water removal is from the bottom of the separator 26 through pump 34 and line 35 to the shale quench through line 14. This water contains the carbon, and inorganic fines which are carried over with the retort off-gas and sediment out in the separator 25. An advantage of my process is that the fines which normally are found in the retort oil, are preferentially found in the water phase. This not only simplifies the oil recovery processes, but also permits them to be disposed of without further separation in a simple step by putting them back in the retort in a location with low gas velocity where they will go out with the retorted shale.

The shale oil, which is lighter than and essentially immiscible with water, is removed for processing through line 36. The temperature in the separator is kept at about 140°F. to assure that a clean separation of the water and oil takes place.

Make up water 38 for the process is supplied as required through line 38.

EXAMPLE II

The retorting process, described in Example I, is modified as shown in FIG. 7, to give a profiled temperature retorting process which is somewhat more versatile than that originally presented. In FIG. 7, provision has been made to include a recuperator 41 in the off-gas line 10 from the superheater 30 to preheat the combustion air. This serves to temper the combustion gases going to the lock hopper 2 and prevents overheating the shale in this phase of the process in addition to increasing the efficiency and fuel economy of the superheater.

The main addition, however, is the inclusion of water line 40 from the quench line 14 to atomizers in the steam injectors 12. (Note the number of injection points has also been increased.) The metering valves 41 are controlled thermostatically (individually) from sensors in the injectors 12. Water with its high latent heat of vaporization, is uniquely suited for this particular application. The controlled injection of it into the superheated steam will allow the temperature of the water vapor going into the retort to be efficiently and precisely controlled for each injection point, and thus a profiled temperature can be accurately maintained in the retort (depending naturally, on a constant shale flow and constant controlled water vapor rates for each set of operating conditions).

EXAMPLE III

A further embodiment is given in FIG. 8 which is similar to the process equipment shown in FIG. 7, but includes a shale preheater 44. Superheated water vapor is delivered through line 13 and control valve 46 to heat the incoming shale to the temperature of condensing water at the pressure the retort is being operated at. The partially condensed vapors mix with the retort gases and flow out through line 7 to the recovery section of the process. If required, water can be added through valve 45 and line 42 to control the steam temperature.

Non-condensible gases which may build up in the refluxing zone at the top of the preheater 44 are bled off through line 47 and run through a partial condenser 48 to recover water vapor prior to being bled into the stack gas line 10.

MODIFICATIONS OF THE INVENTION

It should be understood that the invention is capable of a variety of modifications and variations which will be made apparent to those skilled in the art by a reading of the specification and which are to be included within the spirit of the claims appended hereto. For example, it is applicable to in situ processing, as well as conventional processing in a variety of type of equipment. It is not intended that the invention be related to specific types or kinds of mechanical equipment in which retorting can be accomplished.

For example, the rotary hearth furnace of FIG. 5 can be substituted for the vertical retort of FIG. 1. Such rotary hearth furnances are described in various U.S. patents, including U.S. Pat. Nos. 3,227,627 and 3,475,286. For use with the present invention, these furnaces should be modified to include a perforate hearth 50 with steam injection 51 means to allow steam to penetrate upward through the oil shale bed formed on the hearth. Feed chute 53 and rabbles 54 function as described in the above U.S. patents except that, of course, no combustion takes place in furnace chamber 54 and vapors for recovery exit through exhaust conduit 55.

What is claimed is:

1. In a process for the recovery of organic values from oil shale by contacting said oil shale with superheated water vapor, the improvement comprising enhancing the recovery of said hydrocarbon values by, in combination, a. contacting particles of said oil shale with said superheated water vapor at a surperficial gas velocity of at least 20 feet per minute and at a pressure in the range of from about 1 to about 150 p.s.i.a., b. providing said contact with said superheated water vapor at a temperature of from about 850° to 950°F., to produce an effluent stream comprising superheated water vapor, hydrocarbon vapors, hydrogen, and carbon oxides.

2. A process according to claim 1 additionally comprising the steps of:

c. treating said effluent stream to condense at least a portion of said superheated water vapor and said hydrocarbons to form an immiscible stream comprising water and oil, and gases (comprising hydrogen)

d. physically separating said oil and said water and said gases, and e. recycling at least a portion of said water by vaporizing it to form surperheated water vapor for contact with additional quantities of oil shale.

3. A process according to claim 1 wherein said superficial velocity is in the range of from about 20 to about 1000 feet per minute.

4. A process according to claim 1 wherein said temperature during said contact is in the range of from about 850° to about 880°F.

5. A process according to claim 2 wherein at least a portion of said hydrogen is utilized to hydrotreat said hydrocarbons to reduce the sulfur and nitrogen contents thereof.

6. A process according to claim 1 wherein the pressure is from about 2 to about 100 psia.

* * * * *

UNITED STATES PATENT OFFICE

CERTIFICATE OF CORRECTION

Patent No. 3,960,702 Dated June 1, 1976

Inventor(s) Victor D. Allred

It is certified that error appears in the above-identified patent and that said Letters Patent are hereby corrected as shown below:

Column 2, line 19: after "superheated" add --water--

Column 5, line 8: delete "25" and substitute therefor --26--

Column 6, line 5: delete "40" and substitute therefor --42--
delete "14" and substitute therefor --32

Column 6, line 24: delete "46" and substitute therefor --45--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*